US005826298A

United States Patent [19]

Rohrbacher et al.

[11] Patent Number: 5,826,298

[45] Date of Patent: Oct. 27, 1998

[54] SURFACE CLEANER, SPRAYER AND RETRIEVAL UNIT

[75] Inventors: Richard D. Rohrbacher, Phoenix; Kemper Marley, Jr., Scottsdale; Nelson D. Graves, Phoenix, all of Ariz.

[73] Assignee: Cyclone Surface Cleaning Inc., Tempe, Ariz.

[21] Appl. No.: 746,025

[22] Filed: Nov. 4, 1996

Related U.S. Application Data

[63] Continuation-in-part of Ser. No. 615,797, Mar. 14, 1996, which is a continuation of Ser. No. 343,193, Nov. 22, 1994, which is a division of Ser. No. 118,139, Sep. 8, 1993, Pat. No. 5,500,976.

Related U.S. Application Data

[60] Provisional application No. 60/021,062, Jul. 2, 1996.

[51] Int. Cl.[6] ..... B08B 5/04

[52] U.S. Cl. ..... 15/321; 15/322; 15/340.1; 15/353; 15/385

[58] Field of Search ..... 15/320, 321, 322, 15/340.1, 353, 385

[56] References Cited

U.S. PATENT DOCUMENTS

| | | | |
|---|---|---|---|
| 935,559 | 9/1909 | Spangler | 15/385 X |
| 1,093,820 | 4/1914 | Beach | 15/385 X |
| 3,624,668 | 11/1971 | Krause | 15/321 X |
| 3,959,010 | 5/1976 | Thompson et al. | 15/320 X |
| 4,107,816 | 8/1978 | Matthews | 15/322 X |
| 4,191,589 | 3/1980 | Halls et al. | 15/322 X |
| 4,377,018 | 3/1983 | Cain | 15/322 |
| 5,428,863 | 7/1995 | Tanaseccu et al. | 15/322 |

*Primary Examiner*—Chris K. Moore
*Attorney, Agent, or Firm*—Brinks Hofer Gilson & Lione

[57] ABSTRACT

A cyclonic power wash system including a roving sprayer and retrieval unit that uses high pressure, high temperature water for selectively cleaning large, flat, concrete or asphalt surfaces and can retrieve a substantial portion of the dispensed water along with the matter picked up from the surfaces. The sprayed water is reclaimed by the retrieval rotor that is power driven. The roving sprayer and retrieval unit can function as a stand alone unit or in combination with a component carrying platform that includes a reclamation tank in which the retrieved water and matter is processed and separated so that the separated water can be reused by the roving sprayer and retrieval unit. A rotary union in the roving sprayer and retrieval unit, prevents water, passing from the inlet of the rotary union to the discharge thereof, from leaking through or around a seal that is formed by pressing together a pair of hard, durable sealing surfaces.

28 Claims, 7 Drawing Sheets

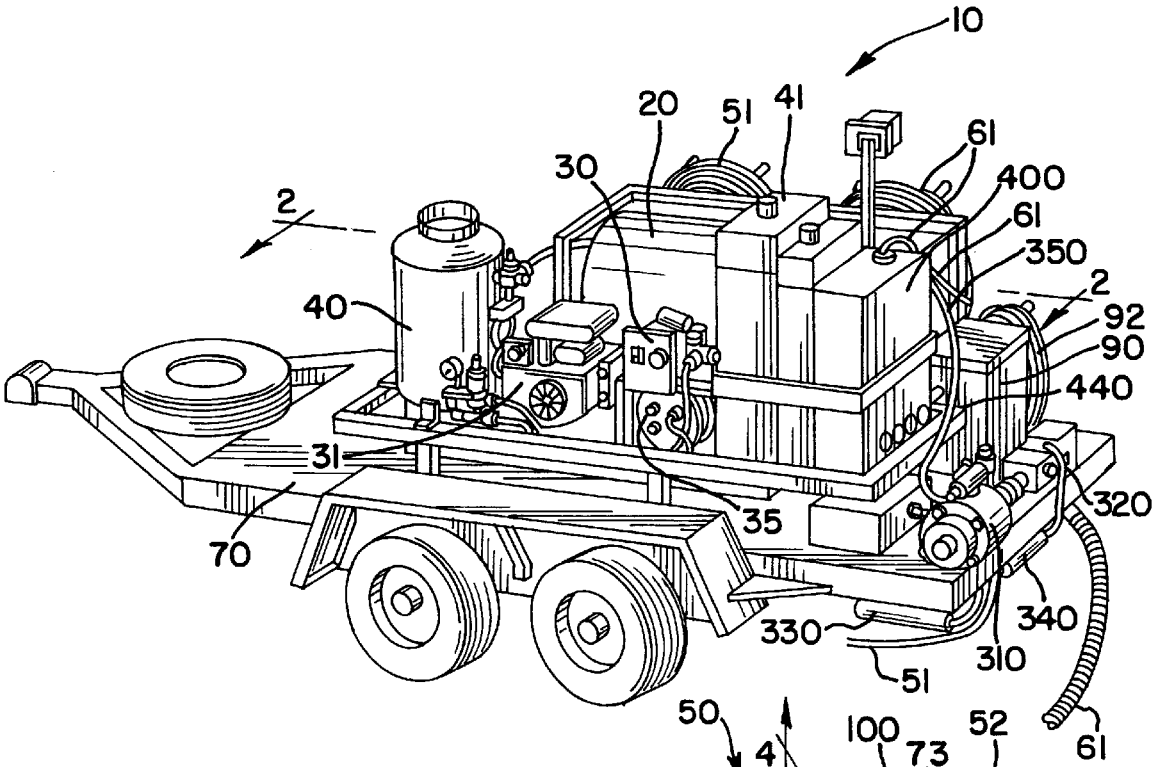
FIG.1
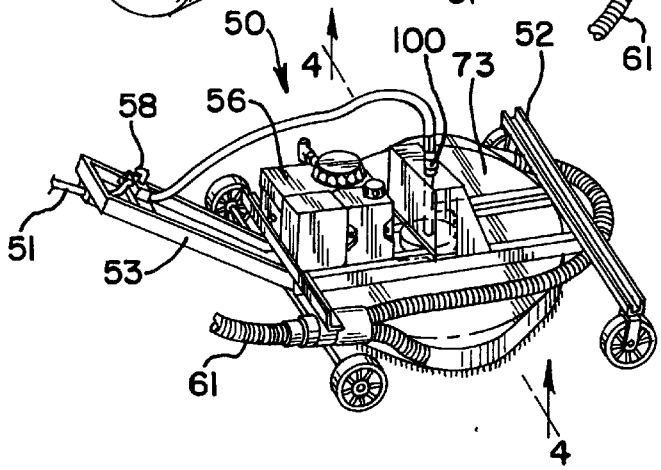
FIG.2
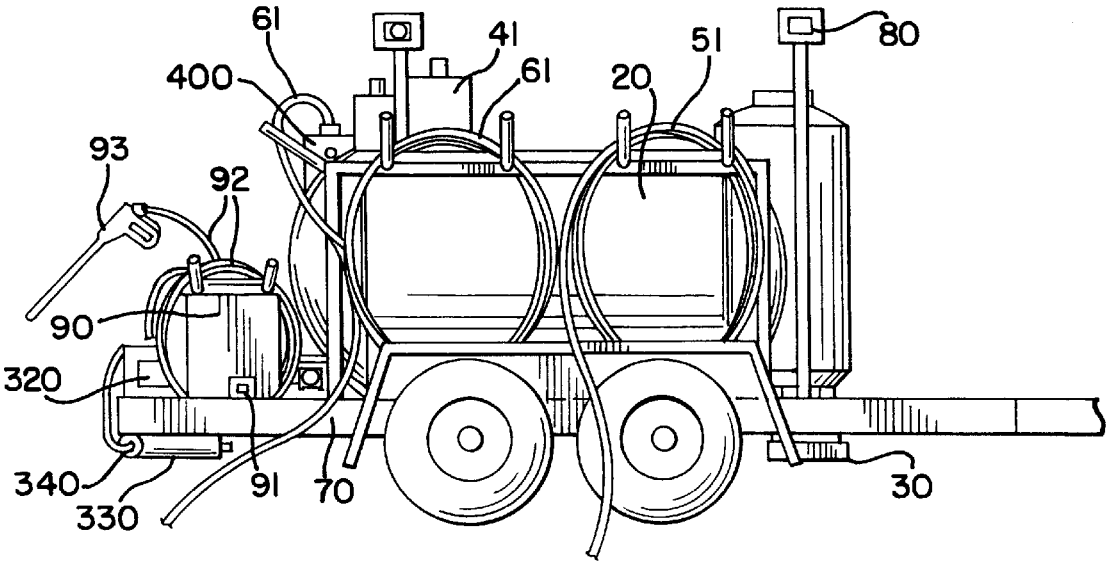

SURFACE CLEANER, SPRAYER AND RETRIEVAL UNIT

CROSS-REFERENCES

The present application is a continuation in part of U.S. application Ser. No. 08/615,797 filed Mar. 14, 1996 which is a File Wrapper Continuation of now abandoned U.S. application Ser. No. 08/343,193 filed Nov. 22, 1994, and now abandoned, which is a Division of U.S. application Ser. No. 08/118,139 filed Sep. 8, 1993. The present application is also a continuation in part of U.S. Provisional application Ser. No. 60/021,062 filed on Jul. 2, 1996.

BACKGROUND OF THE INVENTION

The present invention relates generally to a mobile cyclonic power wash system that uses sprayed water for cleaning flat surfaces such as concrete, asphalt, and other various hard surfaces. The present invention also relates to a mobile cyclone sprayer that has an improved rotary blade that reclaims the sprayed water and the waste that has been picked up from the surface in an improved manner. The present invention also relates to a power wash system that reclaims and filters the sprayed water and then recycles the filtered water to the system for further use in cleaning.

Apparatus and methods for selectively cleaning flat surfaces using a mobile cyclonic power wash system are well known in the art. The mobile cyclonic power wash system generally sprays water at high rotating speeds to clean the surfaces. A typical mobile cyclonic power wash system includes a water storage means for holding the water that is to be used for cleaning, a water pumping system for pumping and pressurizing the water from the storage means, and a water cyclone sprayer for spraying the water onto the surfaces. Typical power wash system can further include a water heating system for heating the water so that high temperature as well as high pressure water is provided for cleaning surfaces.

One of the problems with the prior art power wash systems is that they do not have the capability to recover much of the liquid that has been disperse. As a result the pollutants contained in the unrecovered liquid remains on the surface that is being cleaned. Also the liquid is lost from the system and must be replaced from an outside source provided one is available at the work site. Furthermore the prior art machines do not have the capability to recycle the liquid that is recovered such that the recycled liquid is clean enough to be effective is subsequent cycles. The prior art systems cannot operate as independent, self-contained systems in which the water is continuously reclaimed, filtered, and recycled for further use by the power wash system. Therefore, the operation of the prior art systems is limited by the amount of water that can be stored or transported by the system (i.e. by the capacity of the water storage means). When operating at a location where fresh water is not available and polluted liquid cannot be deposed of at the work site, then the operator of the system must leave the work cite, to dispose of the polluted water and to replenish with new clean water from an outside source. As a result, the prior art systems required the use of large amounts of water, and fails to recover much of the waste. Moreover, environmental objections are increasingly being raised against dumping harmful liquid waste into the drainage systems. Thus, there is a need to recover and reclaim most of the water that is sprayed in outdoor cleaning systems. There is also a need to isolate and retain the recovered waste products for acceptable disposal.

In overcoming the problems and limitations of the prior art, it is an object of the present invention to clean flat surfaces using a mobile cyclonic power wash system with a water reclamation system that will recover substantially all of the water that is dispersed. The mobile cyclonic power wash system can also be combined with a filter and recycling system, which reclaims and filters the water sprayed by the power wash system and has the capacity to return close to 100% of the water used by the power wash system. The recovered liquid is processed, which removes and isolates the waste, and the cleaned liquid is stored so that it can be available for the continuous use of the system.

SUMMARY OF THE INVENTION

This invention relates to a power wash system which uses high pressure water for cleaning flat surfaces and recover a substantial portion of the dispersed water that contains mater recovered from the surface. The system includes a water storage means for holding water to be used for cleaning, a water pumping system for pumping and pressurizing the water and a cyclone sprayer for spraying the water onto the surface. An improvement in the system includes a power driven retrieval rotor that picks up nearly all the liquid that has been sprayed by the system. The recovered liquid can then be filtered, processed and placed in a storage means so that it can be further used for cleaning by the system. The system also preferably includes a water heater for heating the water.

A still further feature of this aspect of the invention is the construction of the filtration tank which includes an inlet at the top, a removable slanting trough below the inlet with a screened outlet at the bottom of the trough for filtering large matter from the water, a plurality of cascading chambers for allowing the water to successively fill a chamber and flow over into an adjacent chamber leaving behind smaller matter still present in the water continuously passing cleaner water to the next chamber.

A still further feature of this aspect of the invention is a mobile platform on which the system components are mounted for transport to a job site.

A further aspect of the invention is in the water cyclone sprayer of the power wash system, which sprays high pressure, high temperature water at a high rotating speed. An improvement in this sprayer is in the rotary union seal, which is formed between two silicon carbide surfaces, one stationary and the other rotatable at high rpm with the water passing through a central bore through the sealing members which prevents leakage through the rotary union seal, and an o-ring which prevents leakage around the rotary union seal.

A further feature of this aspect of the invention is the method of effecting a leak proof seal in the rotary union which includes a non-rotatably, slidingly mounting a cylindrical support member which has affixed to one end thereof a first silicon carbide seal face. The support member has a central bore therethrough and the sliding mounting forms an interface between a central bore formed in the housing and the outer surface of the cylindrical support member. This feature of the invention further includes sealing the interface by sandwiching an o-ring between the other end of the cylindrical support member and a downwardly biased washer with the o-ring that engages the housing central bore. A spindle having a second silicon carbide seal face affixed to its end that is adjacent the cylindrical support member is supported within another central bore. The spindle has a central bore formed therein to its discharge end; thereby, forming a rotary union by sealingly engaging the first and second silicon seal faces. In this method fluid, i.e. water, entering the inlet end of the housing passes through the central bores of the members, o-ring, spindle and rotary union and out the discharge end of the spindle without leaking around or through the seal at the rotary union.

A further feature of this aspect of the invention includes supporting the inner bore of the o-ring by a downwardly axially extended inner bore portion of the biased washer and an upwardly axially extended inner bore portion of the other end of the cylindrical support member. This construction prevents the o-ring from being blown into the central bore of the cylindrical support member by the high pressure water present at the interface.

A still further feature of this aspect of the invention includes applying an upward force to the spindle to further sealingly engage the seal faces in reaction to the downward force of the fluid exiting from the nozzles affixed to the retrieval rotor.

BRIEF DESCRIPTION OF THE DRAWINGS

FIG. 1 is a front perspective view of a mobile power wash system having a water reclamation and filter recycling system and the improved retrieval rotor and rotary union of the present invention.

FIG. 2 is a rear elevation view of the mobile power wash system having a water reclamation and filter recycling system taken along the line 2—2 of FIG. 1.

DETAILED DESCRIPTION OF THE PREFERRED EMBODIMENT

Figure 9:
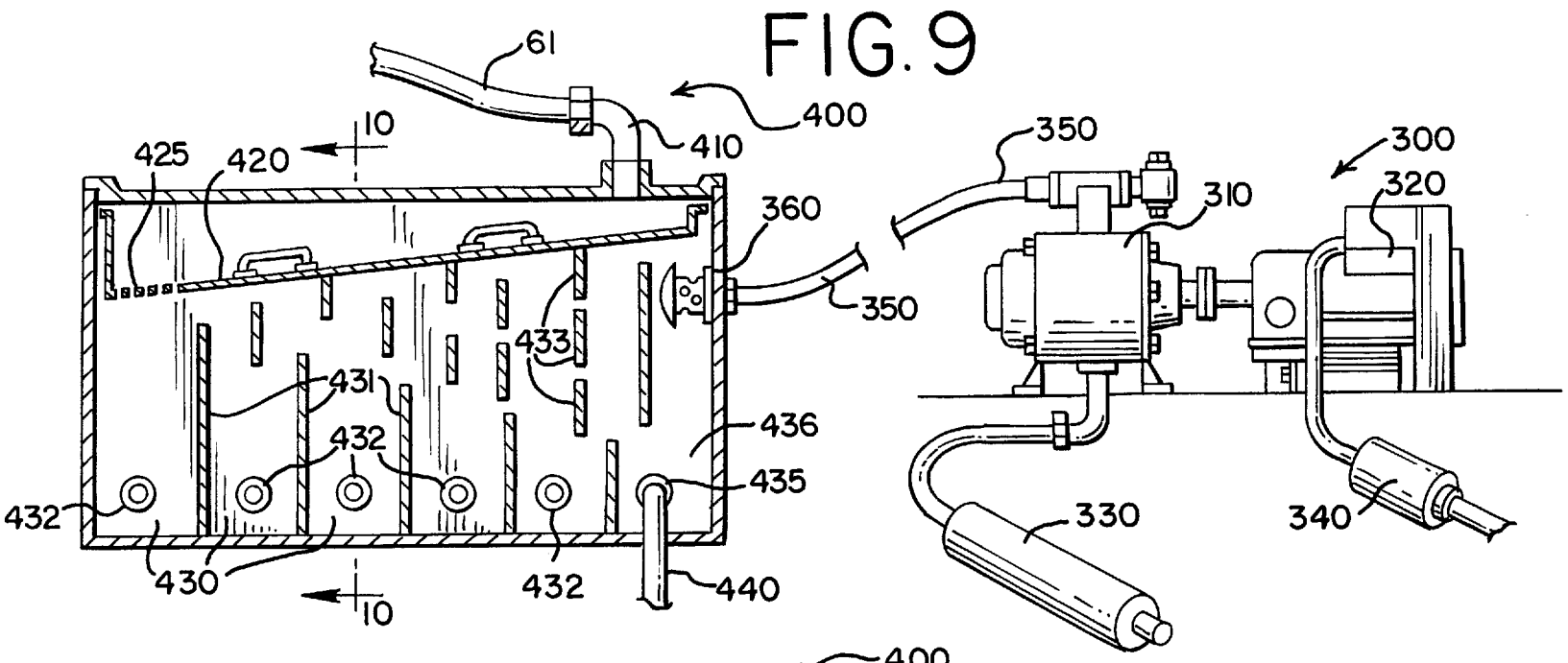
FIG. 9 is a front sectional elevation view of the water filtration tank for the water reclamation and filter recycling system of the present invention.
Figure 10:
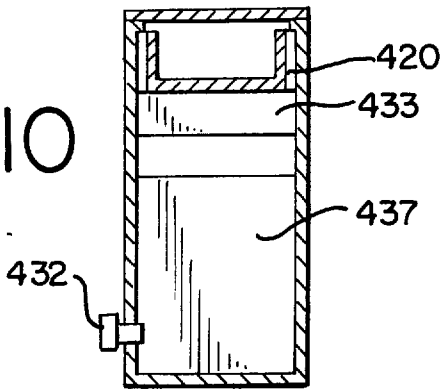
FIG. 10 is a side sectional elevation view of the water filtration tank for the water reclamation and filter recycling system taken along the line 10—10 of FIG. 9.

FIG. 1 is a perspective view of the mobile cyclonic power wash system 10 which includes the novel roving sprayer and retrieval unit 50 that functions to spray the water and reclaim the sprayed water and recovered waste. FIG. 2 is a side view of the mobile cyclonic power wash system 10. A mobil component carrying platform 70, FIGS. 1–2, is provided for mounting and transporting the processing components of the cyclonic power wash system 10. In FIGS. 1 and 2 the component carrying platform 70 is a flat bed trailer of the type that is towed by a vehicle such as a truck. In the preferred embodiment the component carrying platform 70, for these processing components, is the bed of a truck having a closed cargo section. In this embodiment of the invention a vacuum source 300 and a filtration tank 400 as shown in FIG. 9 are used.

The roving sprayer and retrieval unit 50 is connected to the component carrying platform by a flexible water transporting hose 51 and a water and a waste return hose 61. In the embodiment, illustrated in FIG. 1, the hoses 51 and 61 are of a length that will permit the component carrying platform 70 to remain stationary while the roving sprayer and retrieval unit 50 cleans a section of surface. In this embodiment when the section, defined by the lengths of hoses 51 and 61, is completed the component carrying platform is moved to a new location from which the roving sprayer and retrieval unit 50 process another section.

As seen in FIGS. 1 and 2, the mobile cyclonic power wash system 10 includes a component carrying platform 70 on which a water storage component 20 for holding the water to be used for cleaning by the system 10 and a water pumping component 30 for pumping and pressurizing the water from the storage component 20 are mounted. The roving sprayer and retrieval unit 50 sprays the water on the surfaces to be cleaned as well as recovers the sprayed water along with waste recovered from the surface being cleaned. Component carrying platform 70, along with the components carried thereby, is transportable from job site to job site. A water heater component 40 may be included, as part of the power wash system 10, for heating the water.

As a further option, the power wash system 10 can include a chemical treatment system 90. The treatment system 90 would be used prior to operating the power wash system 10 to apply chemicals to the surfaces to be cleaned for the purpose of loosening hard to remove dirt, grease, oil, grime, and the like from the surface. The treatment system 90 comprises an independently power operated pump 91 which pumps chemicals through a hose 92 to a spray gun 93. The chemicals are sprayed on the surfaces to be cleaned through spray gun 93.

During operation of power wash system 10 water in the storage means 20 is pumped and pressurized by the pumping system 30. The pumping system 30 is typically a water pump that is driven by a gas-powered engine 31 which also powers a generator 35. The water may then be either pumped to the water heater component 40 if hot water is desired or pumped directly to the roving sprayer and retrieval unit 50 if hot water is not desired. The water heater component 40, can burns diesel fuel that is stored in fuel tank 41 to heat the water. The water is heated to an operating temperature of 250° F. An electrical thermostatic switch (not shown) turns the oil burner "on" when the water temperature falls to 230° F. and "off" when the water temperature rises to 255° F.

The water is directed through a water transporting hose 51 and lever type on/off valve 58 to the roving sprayer and retrieval unit 50. The water under high pressure and/or high temperature is sprayed by the roving sprayer and retrieval 50 onto the surfaces to be cleaned.

As shown in FIG. 1, the roving sprayer and retrieval unit 50 comprises a mobile frame 52 having a handle 53 secured thereto that allows an operator to walk behind and control the movement of the roving sprayer and retrieval unit 50. An inverted tub or shroud 73 is secured to the under surface of the mobile frame 52. The discharge end of the flexible water transporting hose 51 is seen connected to the rotary union 100 and an internal combustion engine 56 is shown mounted on the mobile frame 52. Engine 56, as shall be discussed in more detail, drives the retrieval rotor 59. Although this power source is disclosed as an internal combustion engine 56 the use of a 12 volt electrical engine is also contemplated.

Figure 3:
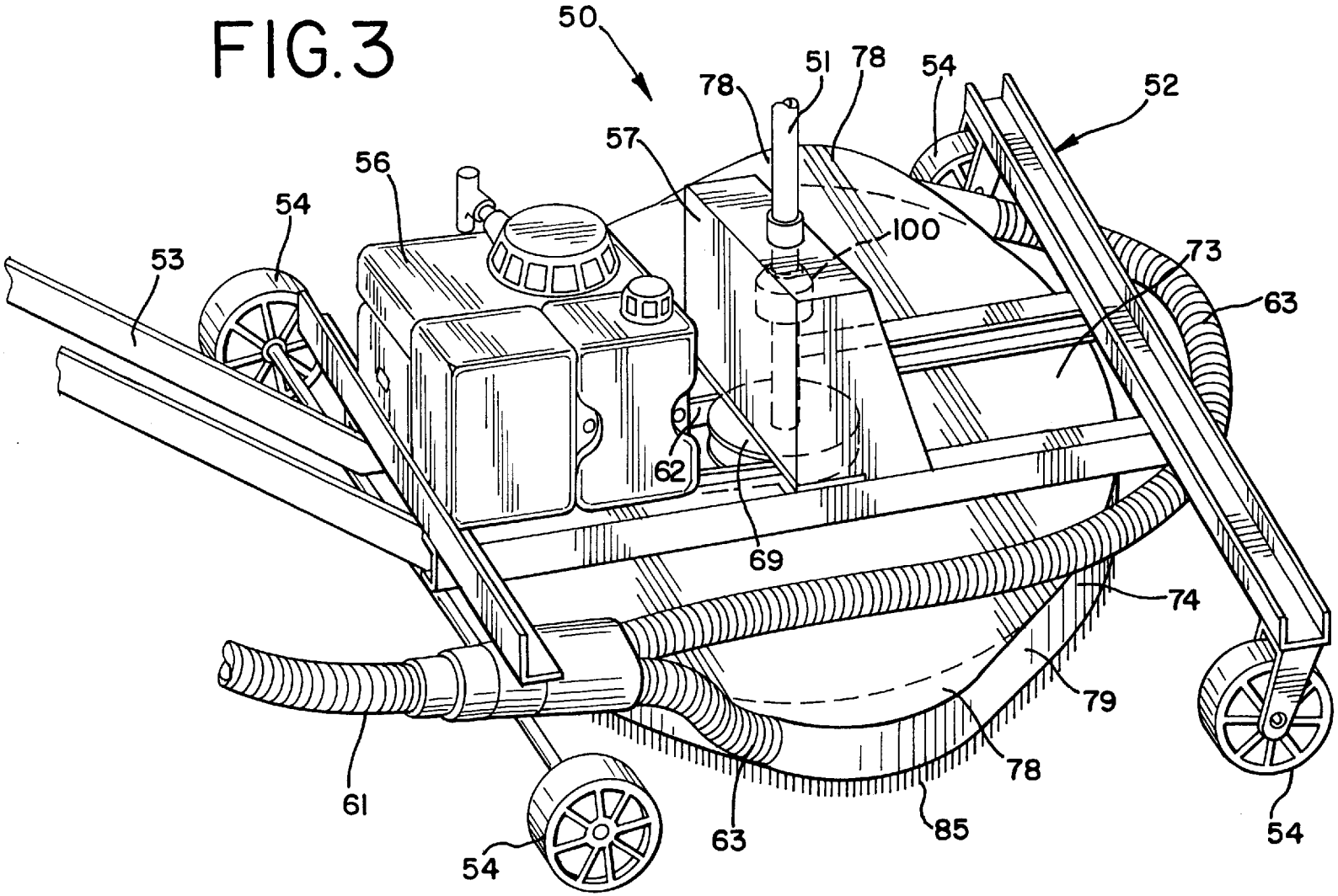
FIG. 3 is a top rear perspective view of an embodiment of the sprayer and retrieval unit of the present invention including the improved retrieval rotor attached.

FIG. 3, which is a perspective view of the roving sprayer and retrieval unit 50, discloses a mobile frame 52 that is supported from the ground surface by four wheels 54. A handle 53 is secured to the mobile frame 52 that allows an operator to walk behind and control the water flow to and movement of the roving sprayer and retrieval unit 50. An inverted tub or shroud 73 is secured to the under surface of the mobile frame 52. The discharge end of the flexible water transporting hose 51 is connected to the rotary union 100 through which pressurized water passes to the water discharge jets 55. An internal combustion engine 56 is mounted on the mobile frame 52. Engine 56, drives the retrieval rotor 59 through a belt 62 and sheave 69. The inverted tub or shroud 73 is provided with a pair of exit ducts 78 that are spaced 180 degrees from each other. Each exit duct 78 empties into a conduit 63 and both conduits 63 merge into the waste return hose 61. A rotary union, such as the rotary union 100 shown in FIGS. 7, 7A, 7B, 7C and 8 is mounted underneath cover 57. The retrieval rotor 59 is attached to the spindle 170 of the rotary union 100. This power wash system 10 is extremely efficient at cleaning dirt, grease, oil, grime, and the like from flat surfaces such as asphalt and concrete floors.

Figure 4:
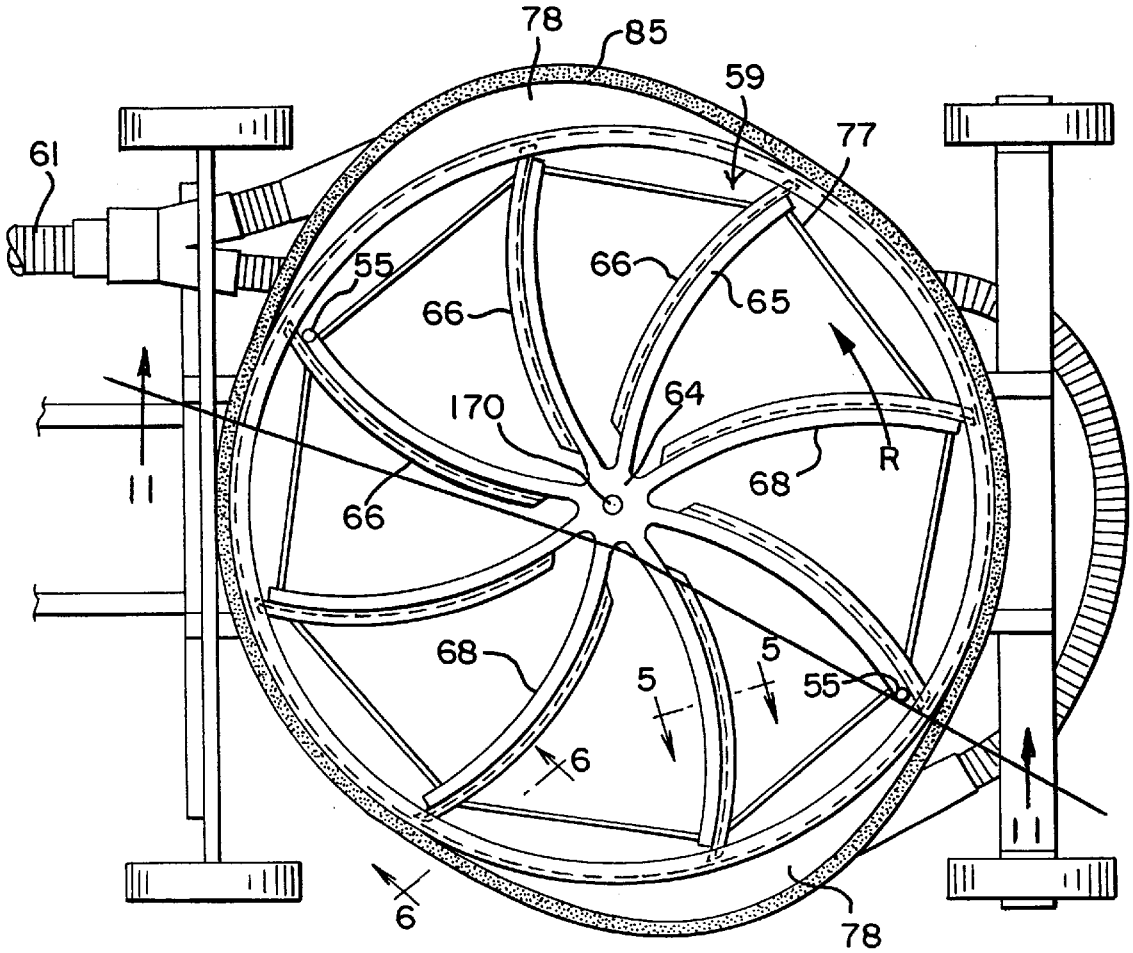
FIG. 4 is a bottom view of the embodiment of the sprayer and retrieval unit shown in FIG. 3.

FIG. 4, a bottom view of the roving sprayer and retrieval unit 50, discloses the internal surface of the inverted tub or shroud 73. The retrieval rotor 59 is mounted for rotation within the confines of the inverted tub or shroud 73. The retrieval rotor 59, includes swept back rods 65 that, in the preferred embodiment, are secured by welding to the rotating spindle 170 of the rotary union 100. Another alternative would be to provided the retrieval rotor 59 with a central hub that could be secured to the spindle 170. As shall be discussed later in greater detail the rotating spindle 170 has a central bore 161 that receives water under pressure that has flowed through the rotary union 100. The retrieval rotor 59 rotates in the direction indicated by arrow R such that the rods 65 appear as swept back. Although the retrieval rotor 59 of the preferred embodiment has eight swept back rods 65, the number is not critical and more or fewer rods could be used. Water discharge jets 55, spaced 180 degrees from each other, are secured to the extremities of two of the swept back rods 65.

Figure 5:
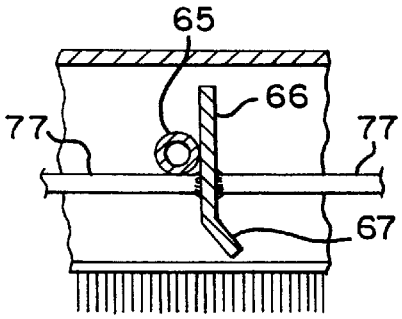
FIG. 5 is a cross-sectional view taken through one of the swept back rods and blades of the retrieval rotor taken along line 5—5 FIG. 4.

A curved blade 66 having a bottom forwardly extending lip 67 is secured to each of the swept back rods 65. The blades 66 are swept back in the same curvature as the swept back rods 65 and have flat front facing curved surfaces 68. The curved blades 66 are formed along a radius that is equal to the radius of the inverted tub or shroud 73 and their length is about ⅛ the circumference of the inverted tub or shroud 73. Thus, eight blades 66 can be fabricated from a hoop having a diameter equal to the diameter of the inverted tub or shroud 73. A cross section of a blades 66 is shown in FIG. 5. The lip 67 extends forward, into the direction of rotation, and functions to prevent water on the surface of the blade 66 from flowing off the bottom edge. As the retrieval rotor 59 rotates, the blades 66 function as fan blades that pick up water and debris from the underlaying surface. The water flows, as a result of centrifugal force, along the flat curved surface 68 of the blades 66 toward the outer extremities of the blades 66. A stabilizer 77 connects the outer extremity of each blade 66 to the next adjacent blade. The stabilizers 77 function to prevent twisting and flexing of the retrieval rotor 59.

Figure 6:
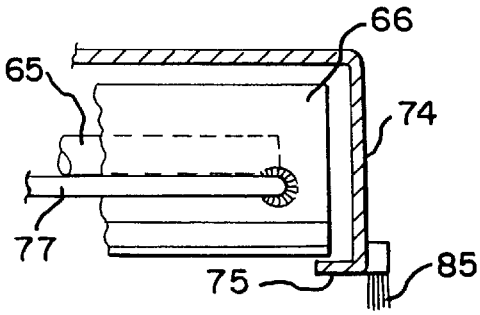
FIG. 6 is a cross-sectional view taken through one of the stabilizers of the retrieval rotor and the vertical wall of the tub taken along line 6—6 of FIG. 4.

As best seen in FIG. 6, which is a cross section view of the rim 74 of the inverted tub or shroud 73, the rim 74 of the inverted tub or shroud 73 has a lip 75 formed thereon. The outer extremities of the blades 66 extend into a channel 76 formed by the upper surface of the inverted tub or shroud 73, its rim 74 and lip 75. The water that flows off the outer extremities of the blades 66 flow into channel 76 and the momentum of the water causes it to continue flowing in the direction of rotation of the retrieval rotor 59.

The inverted tub or shroud 73 is provided with a pair of exit ducts 78 that are spaced 180 degrees from each other. A section 79 of the rim 74 of the inverted tub or shroud 73 is flared out to form an opening for each of the exit ducts 78. The stream of water flowing in the channel 76 follows the section 79 into an exit duct 78. Each of the exit ducts 78 are connected through conduits 63 to the water and waste return hose 61.

A brush 85 is secured to the outer lower edge of the rim 74 of the inverted tub or shroud 73. The brush 85 extends downwardly toward the surface being cleaned and serves several functions. The retrieval rotor 59 functions as a fan blade that sucks water and waste up and pumps the water and waste along with a large volume of air out the exit ducts 78. This air is drawn in along the space between the peripheral edge of the rim 74 and the surface being cleaned. The brush 85 functions as a partial seal of this space that controls the magnitude of the vacuum that is created. If the brush 85 is too thick, making it difficult for air to pass therethrough, a vacuum is created under the inverted tub or shroud 73 which attempts to pull the peripheral edge of the rim 74 into contact with the surface. If on the other hand the brush 85 is too thin or too porous, thus permitting air to flow unencumbered through the space, then the vacuum created will be insufficient to lift the water and debris from the surface. Thus, the porosity of the brush 85 is critical to the proper operation of this invention. In selecting this brush the objective must be to choose a brush that will permit ambient air to flow into the inverted tub or shroud 73 under the rim 74 and the surface being cleaned. The brush 85 functions as a valve to limit and control the amount of air that can flow into the inverted tub or shroud 73 under the space between the lower edge of the rim and the surface being cleaned. A second function of the brush 85 is to prevent or retard solid waste such as rocks from being thrown out from under the inverted tub or shroud 73. As a result of the driven retrieval rotor, the contour of the internal surfaces of the inverted tub or shroud 73 and the brush 85 water and waste is very efficiently picked up from the surface being cleaned. Further, as a result of centrifugal force, momentum and the pump action water and debris is forced through the exit ducts 78 into the water and waste return hose 61.

Figure 11:
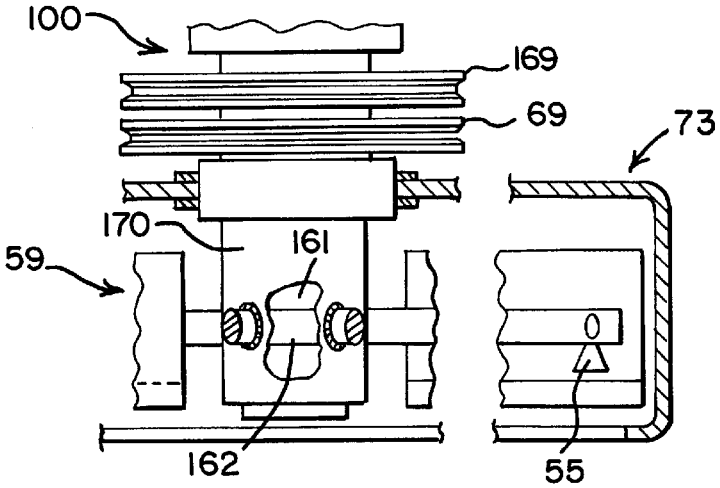
FIG. 11 is an enlarge view of the connection between the retrieval rotor and rotating spindle, which is used in both embodiments of the invention.

Referring now to FIG. 11, which is an enlarged cross section view taken along the lines 11—11 of FIG. 4, the rotating spindle 170 of the rotary union 100, sheave 69 and portions of the retrieval rotor 59 are shown. The swept back rods 65, upon which discharge jets 55 are carries are comprised of a single hollow tube that extends through the central bore 161 of the rotating spindle 150. An opening 162 is formed in the portion of the hollow tube 65 that is located in the central bore 161. Water under pressure thus flows from the central bore 161 through opening 162 into the hollow rod 65 and then to the discharge jets 55. The high pressure water is then discharged to the surface being cleaned through the water discharge jets 55. The swept back rods 65 that do not function as water conduits, could be hollow or solid and are welded to the outer surface of the rotating spindle 150.

It should be noted that in FIG. 11 a second sheave 169 is shown. Sheave 169 is not used with this embodiment of the invention but is used with a subsequently described embodiment. FIG. 11 thus illustrates the rotating spindle 150 which can be used with either embodiment of the invention.

The operation of the retrieval unit 50, as seen in FIGS. 4–6 and 12, will now be discussed. The swept back blades 66 having lips 67 along their lower edges that extend into the direction that the blades travel function as fan blades that forces air to move toward the free ends of the blades 66. This creates a vacuum below the blades. The vacuum causes the water and debris to be lifted from the surface being cleaned. As the retrieval rotor 59 rotates the lips 67 function to physically scoop the water up such that it reaches the flat portion of the blade and is then caused by centrifugal force to moves toward the free end of the blade.

The rim 74 of the inverted tub or shroud 73 has a lip 75 that cooperate to retain the water and waste and pump it away from the surfaces to be cleaned. Conduits 63 are attached to an ends of exit ducts 78 through which the water and waste is transported to the return hose 61 and then to the filtration tank 400.

The water along with stones and other debris flow through the hose 61 to a filtration tank 400 which, in one embodiment, is assisted by a vacuum source 300 as seen in FIG. 9. Vacuum source 300 comprises a vacuum pump 310 and a gas driven motor 320 which drives and operates the pump 310. The vacuum source 300 may further comprise a silencer 330 attached to the pump 310 and an exhaust muffler 340 attached to the motor 320 so that the vacuum source 300 may be operated with less noise (i.e. for quieter operations in or near residential areas).

The water is then passed through the filtration tank 400 so that the water is filtered and cleaned for re-use by the power wash system 10. As shown in FIG. 9, the water to be processed in the filtration tank 400 can be drawn to the tank 400 by attaching the conduit 350 of the vacuum source 300 to the clean end of tank 400 (i.e. the right side of tank 400 in FIG. 9) using an attaching means 360. The vacuum source creates a low pressure in tank 400. This low pressure is transmitted to the hose 61 and exit ducts 78 which sucks the water into the exit ducts 78, through hose 61, and then through the tank 400.

As shown in FIG. 9, the filtration tank 400 comprises a top inlet 410, a removable slanting trough 420 located in the upper portion of the tank, a screened trough outlet 425 located at the lower end of trough 420, a plurality of cascading chambers 430 located in the lower portion of the tank, a drain 432 for each chamber 430, and baffles 433 also located in the central portion of the tank between the screened trough outlet 425 and the vacuum source inlet 350.

The reclaimed water and waste is passed to the tank 400 through inlet 410, and the water flows downwardly along the trough 420 to the screened outlet 425. Large debris and particles are removed from the water as the water passes through screened outlet 425. Thus, large debris is collected and retained in the trough 420 which is located in the upper portion of the tank 400. The trough 420 can be removed from tank 400 so that the large debris and particles can be easily cleaned from it.

The water is then successively passed through a plurality of cascading chambers 430. The chambers 430 are each separated by a series of dividing walls 431 that are descending in height. The water successively fills each chamber and then flows over to the next adjacent chamber so that debris and particles still present in the water are left in a chambers 430, and cleaner water is continuously passed to the next chamber. The water is then sufficiently cleaned and available for re-use when it reaches the last chamber 436.

The filtered water exits the tank 400 through outlet 435 located in the last chamber 436 after passing through a one-way, spring loaded, water check valve (not shown) and is transported by gravity feed or by pump (not shown) through a conduit 440 to storage means 20. This filtered water is then available for reuse by the power wash system 10. If a pump is used to pump the water from the outlet 435 to the storage means 20, the pump may be automatically operated by a float switch (not shown) which regulates the water level between predetermined high (pump ON) and low (pump OFF) water levels. A drain 432 is provided for each chamber 430 so that the debris and particles that remain in these chambers can be removed.

A plurality of baffles 433 are located below the trough 420 and generally above the chambers 430 to prevent debris, particles, and water from being directly vacuumed into inlet 350 of vacuum source 300. These baffles 433 ensure that the vacuum source 300 and the reclamation and recycling system 60 operate properly.

As stated earlier, a rotary union 100 is typically mounted in the central portion of the roving sprayer and retrieval unit 50 on the mobile frame 52. Rotary union 100 functions as a seal and coupling for passing high pressure and high temperature water to the water jets 55. The rotary union is used to maintain the water pressure sufficiently high so that the water jets 55 spray the water downwardly at high speeds.

A problem with prior art rotary unions has been their short life cycle. The components of the prior art rotary unions experienced excessive wear at a fairly fast rate because of the high pressure and high temperature. The rapid deterioration of these parts would cause the seal of the rotary unions to leak, and the result would be that the roving sprayer and retrieval unit 50 would not function properly or effectively.

FIGS. 7, 7A, 7B and 8 show subassemblies of components for an improved rotary union 100 according to this invention. This rotary union 100 is a more effective coupling for passing high temperature and high pressure water to the water jets 55 without causing any leaks in the roving sprayer and retrieval unit 50 and for sufficiently maintaining the water pressure high enough to be an effective cleaning force. This improved rotary union 100 is also designed to be more durable since its components do not wear out as fast as the components of the prior art rotary unions. At high temperatures small amounts of water can "weep" through the engaging surfaces of the silicon carbide components.

The improved rotary union 100 includes a first subassembly of components 110 fixedly and non-rotatably mounted to the inverted tub or shroud 73 which is attached to the mobile frame 52 of the roving sprayer and retrieval unit 50 and a second subassembly of components 150 rotatably mounted within the first subassembly 110. The first subassembly 110 provides a first silicon carbide seal surface 125 which is fixed, and the second subassembly 150 provides a second silicon carbide seal surface 165 which rotates at high speed and presses against the first silicon carbide seal surface 125 to create the more effective seal for water passing through the central bore of rotary union 100.

Figure 7:
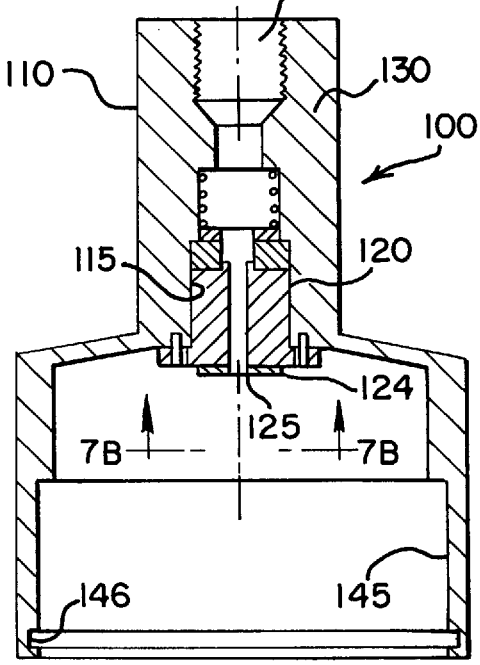
FIG. 7 is a sectional elevation view of a first subassembly of components for the improved rotary union of the present invention.

As shown in FIG. 7, the first subassembly of components 110 comprises a fixed housing 130, which is mounted to the mobile frame 52 of the roving sprayer and retrieval unit 50, and a first floating silicon carbide seal member 120, which is non-rotatably, slidably mounted in cylindrical recess 115 in the housing 130 below the inlet 140 and above the recess 145. The housing 130 has an inlet 140 located at its upper portion for receiving the water that is to be sprayed by roving sprayer and retrieval unit 50 and has a recess 145 located at its lower portion for receiving the second subassembly of components 150.

Figure 7A:
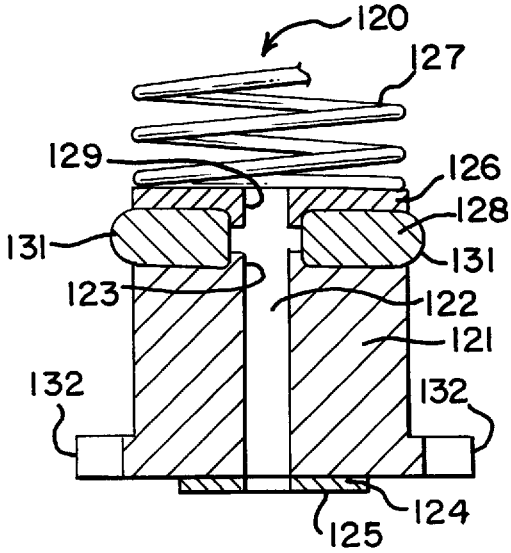
FIG. 7A is an enlarged elevation view in partial section of the first floating silicon carbide seal member that is a part of the improved rotary union shown in FIG. 7.
Figure 7B:
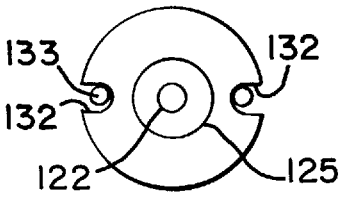
FIG. 7B is a bottom elevation view taken along the line 7B—7B of FIG. 7 showing the non-rotational engagement of the upper floating seal support member.
Figure 7C:
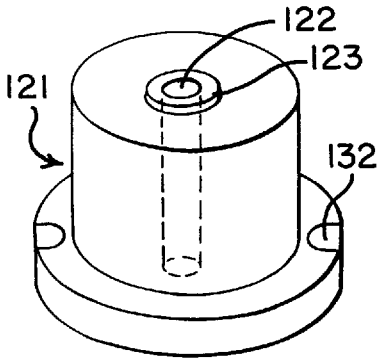
FIG. 7C is a perspective view of the upside down T-shaped cylindrical support member.

FIG. 7A shows an enlarged side view of the first floating silicon carbide seal member 120. The seal member 120 comprises an upside down T-shaped cylindrical support member 121, a silicon carbide component 124 affixed at the discharge end of member 121, an o-ring 128, an inlet end member which may be a flat washer 126, and a steel spring 127. Spring 127 biases washer 126, o-ring 128 and support member 121 downwardly so that surface 125 presses against surface 165 when installed as a unit. The T-shaped cylindrical member 121, o-ring 128 and washer 126 have a central inside bore 122. As best seen in FIGS. 7B and 7C, member 121 has at its lower end a pair of recesses 132 which engage a pair of lugs 133 in the housing 130 to permit slidable (floating) but non-rotational movement of member 121 in recess 115. (Alternatively, member 121 may be formed with a pair of lugs which fit into recesses in housing 130). T-shaped member 121 at its other end also has a raised lip 123 at its upper portion extending into the central bore 121 of o-ring 128 and supporting its inner surface. The silicon carbide component 124 is affixed to the bottom of the T-shaped cylindrical member 121 and provides the first silicon carbide seal surface 125, which faces downwardly. The o-ring 128 is placed on top of the raised lip 123 of the cylindrical member 121, and the inner bore of the o-ring 128 abuts the raised lip 123.

The flat washer 126 is placed on top of the o-ring 128. The flat washer 126 comprises a counter-sunk inner bore 129, which extends partially into the inner bore of the o-ring 128 and abuts and supports its inner surface. The o-ring 128, in effect, is sandwiched between the end of raised lip 123 of the cylindrical member 121, on its one hand, and the end of countersunk bore 129 of the flat washer 126, on the other hand. The vertical edges 131 of washer 126 slidingly engage in the inner walls of recess 115 as shown in FIG. 7. This sandwiching feature prevents the o-ring 128 from being blown into the inner bore 122 of the cylindrical member 121 by the high pressure, high temperature water which is present at the interface between o-ring edges 131 and the outside diameter of member 121, on the one hand, and the walls of recess 115, on the other hand. This feature overcomes the problem with prior art rotary unions which have 0-rings that are more easily blown into the inner bore by the high pressure or high temperature water. This sandwiching feature provides a novel way of retaining the o-ring 128 at its set location for proper operation of the rotary union. In this manner, o-ring 128 effectively seals the aforesaid interface and prevents high pressure water from by-passing the rotary union seal at surfaces 125, 165 by attempting to go around member 121 through the interface (slide fit) with recess 115 and cylindrical member 121.

Figure 8:
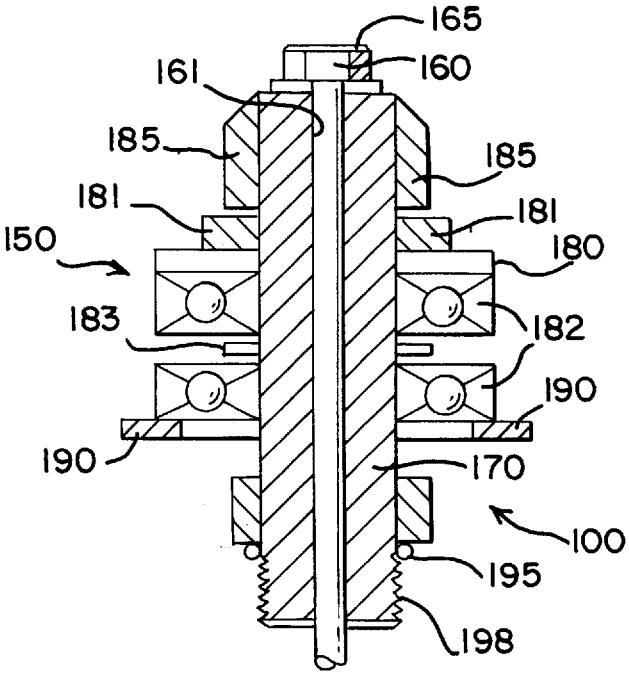
FIG. 8 is a sectional elevation view of the second subassembly of components for the improved rotary union.

FIG. 8 shows the second subassembly of components 150. The second subassembly 150 comprises a rotating spindle 170, a silicon carbide component 160, a roller bearing unit 180, a shaft collar 185, a spring clip retaining washer 190, and a sealing ring 195. The rotating spindle 170 has a central bore 161 into which water that flows through the rotary union 100 is received. The silicon carbide component 160 is mounted at the top of the rotating spindle 170 to provide the second silicon carbide seal surface 165. In operation the second silicon carbide seal surface 165 is pressed and rotated against the first silicon carbide seal surface 125, to form an effective seal which prevents high pressure water passing through the rotary union 100 from leaking through the seal.

The sealing surfaces have been described in the preferred embodiment as being silicon carbide. The sealing surfaces may also be made of tungsten carbide or any other hard, durable material used as a sealing surface which is soft enough to effectively make a seal at the sealing surfaces yet is hard enough to give a long life to the sealing surfaces such as is provided by silicon carbide under the conditions in which the present invention is operated. Using silicon carbide sealing surfaces the lifetime of the sealing surfaces is in excess of 16,000 hours operating at 3000 psi, 250° F. and 1500 rpm.

The roller bearing unit 180 is attached to the central portion of the rotating spindle 170, and this unit 180 provides rotating support to the rotating spindle 170. The shaft collar 185 is also attached to the upper portion of the rotating spindle 170 for holding and supporting the roller bearing unit 180 to the rotating spindle 170. The roller bearing unit 180 comprises a pair of roller bearing columns 182, bearing supports 181 attached to the shaft collar 185, and a bearing spacer 183 attached between the two bearing rings 182. One roller bearing ring is mounted on top of the other at the central portion of the spindle 170. The roller bearing rings 182 provide the rolling function for rotating the spindle 170, and the bearing supports 181 hold the roller bearing rings 182 in position on the rotating spindle 170. The bearing spacer 183 separates the two columns 182 so that these columns can rotate independently.

The spring clip retaining washer 190 is attached below the roller bearing unit 180, and this washer 190 retains the second subassembly of components 150 within the first subassembly of components 110. The washer 190 is retained within a recess 146 at the lower portion of the first subassembly 110 to hold the second subassembly 150 in the first subassembly 110.

The rotating spindle 170, as seen in FIG. 8 has a threaded portion 198 at its lower end for attaching and engaging the retrieval rotor 59. The rotating spindle 170 used in the preferred embodiment is illustrated in FIG. 12.

At the outer peripheral ends of two of the swept back rods 65 are affixed nozzles 55. The upward reaction force to the downward force component of high pressure water exiting through nozzles 55 carried by retrieval rotor 59 causes the second subassembly of components 150 to move upwardly towards the first subassembly of components 110 pressing face 165 upwardly against the downward bias of spring 127 and into sealing contact with-face 125. During operation the second silicon carbide surface 165 rotates against the first silicon carbide surface 125, and a sealing relationship is established between the two surfaces for water passing through the rotary union 100 at high pressure and temperature without leaking through or around the rotary union seal. Operational pressure of 3000 psi at 250° F. and 1500 rpm are readily achievable with the present invention.

Figure 12:
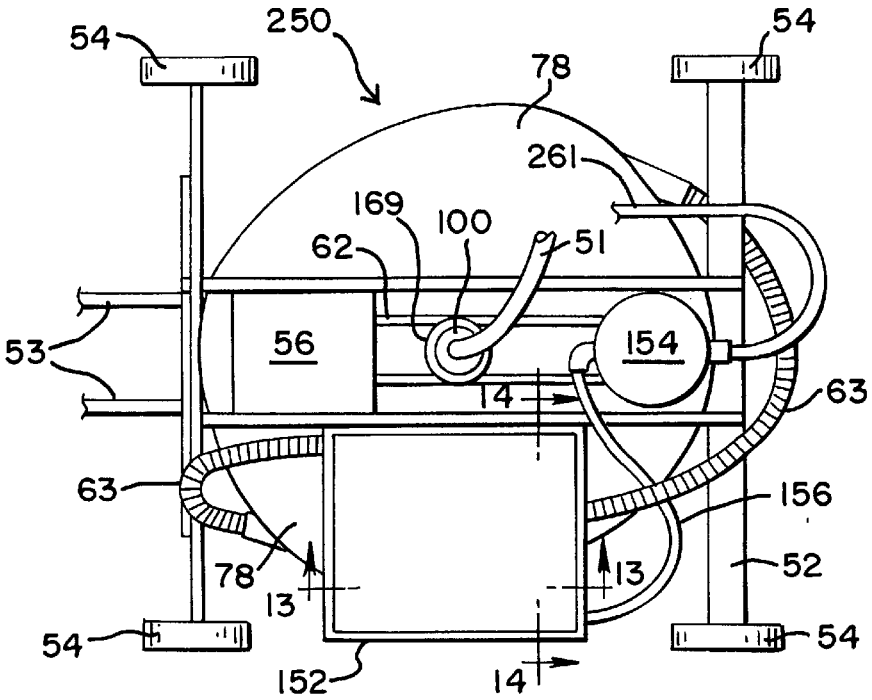
FIG. 12 is a plan view of another embodiment of a sprayer and retrieval unit including a power driven pump for discharging the retrieved water.
Figure 13:
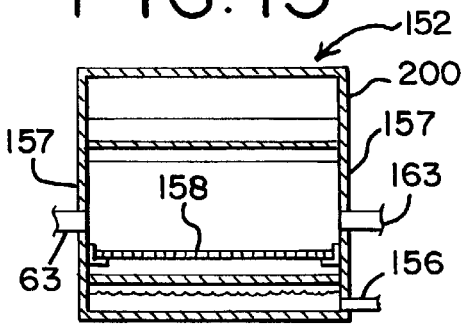
FIG. 13 is a cross section side view of the tank taken along lines 13—13 of FIG. 12.
Figure 14:
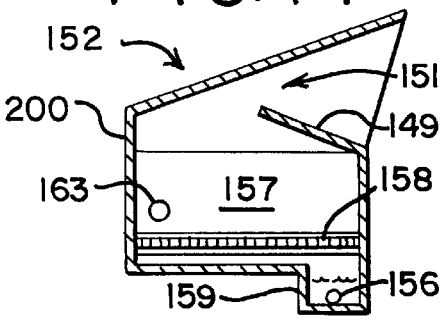
FIG. 14 is a cross section end view of the tank taken along lines 14—14 of FIG. 12.

A second embodiment, which is the preferred embodiment, of the roving sprayer and retrieval unit 250 is shown in FIGS. 12–14. The roving sprayer and retrieval unit 250 of this embodiment can be used either as a stand alone unit or in combination with the reclamation and recycling system 60. The roving and retrieval unit 250 can be used as a stand alone unit in a situation where there is a source of water and facilities to dispose of the unprocessed water that has been recovered by the unit 250. In the following description of the embodiment shown in FIG. 12–14 parts that are identical to corresponding parts in the previously discussed embodiment will be referred to by the same reference number.

FIG. 12, which is a top view of the roving sprayer and retrieval unit 250, includes a mobile frame 52 that is supported from the ground surface by four wheels 54. A handle 53 is secured to the mobile frame 52 which allows an operators to walk behind, control the water flow to and movement of the roving sprayer and retrieval unit 250. A shroud 73 having the shape of an inverted tub or shroud is secured to the under surface of the mobile frame 52. The discharge end of a flexible water transporting hose 51 is connected to the rotary union 100 through which pressurized water is directed to the water discharge jets 55. An internal combustion engine 56 or its equivalent, which could be a 12V electric motor, is mounted on the mobile frame 52. Engine 56, drives the retrieval rotor 59 through a belt 62 and sheave 69 (see FIG. 11). The inverted tub or shroud 73 is provided with a pair of exit ducts 78 that are spaced 180 degrees from each other. Each exit duct 78 empties into a conduit 63 and both conduits 63 flow into tank 152 that is supported by the mobile frame 52. A positive displacement pump is mounted on the mobile frame 52. Pumps of this type are much more efficient than a vacuum system for discharging the water and debris from the roving sprayer and retrieval unit 250. Pump 154 is in fluid communication with tank 152 through conduit 156. Water received by the pump 154 through conduit 156 is discharged through a hose 261. If the roving sprayer and retrieval unit 250 is being used as a stand alone unit then the water is discharged through return hose 261 to the sewage system or other disposal facility.

When the roving sprayer and retrieval unit 250 is being used in combination with the reclamation and recycling system 60, the water is returned through the return hose 261 to the filtration tank 400. An advantage of this embodiment over the previous embodiment is that with this embodiment it is no longer necessary for the reclamation tank to be maintained at a vacuum. The vacuum source 300, that is comprised of the pump 310, motor 320 and conduit 350, illustrated in FIG. 9 can be eliminated. The baffles 433, located below trough 420, in FIG. 9 can also be eliminated from the filtration tank 400 in this embodiment. The positive displacement water pumps 154 carried by the roving sprayer and retrieval units 250 are much more efficient than the vacuum system 300 of the previously described embodiment. Pump 154 is driven by a belt 155 and sheave 169. As seen in FIG. 11 sheave 169 is secured to the rotating spindle 170 of the rotary union 100. As previously discussed rotating spindle 170 is driven by internal combustion engine 56 through belt 62. Pump 154 could instead have its own power source, for example another internal combustion engine or a 12 Volt electric motor. The retrieval rotor 59 used with this embodiment is as shown in FIGS. 4–6 and 11.

The rotary union 100 used in this embodiment is as shown in FIGS. 7, 7A, 7B, 7C and 8 which has been previously discussed.

FIGS. 12 and 13 are cross section view of tank 152 taken along the lines 12—12 and 13—13 of FIG. 11. Water and debris that has been recovered by the retrieval rotor 59 flows through conduits 63 and into the tank 152 through both tank end walls 157. A removable screen 158 is supported within tank 152 at a level below the entrance of conduits 63. Large debris is collected on the upper surface of screen 158 and the water passes through the screen. The screen 158 functions to remove any large debris such as nuts, bolts or nails that could damage the downstream pump 154. The tank 152 includes a sump 159 at one side from which the water is discharged through a conduit 156. As previously discussed conduit 156 is connected to the pump 154 which functions to discharge the water. The tank 152 includes a removable top 200 that provides access to the screen 158 and permits the screen 158 to be removed and cleaned. Top 200 includes an opening 151 through which the interior of tank 152 communicates with the ambient atmosphere. A baffle 149 extends at an upward angle into the opening 151 to prevent water from splashing out.

Figure 15:
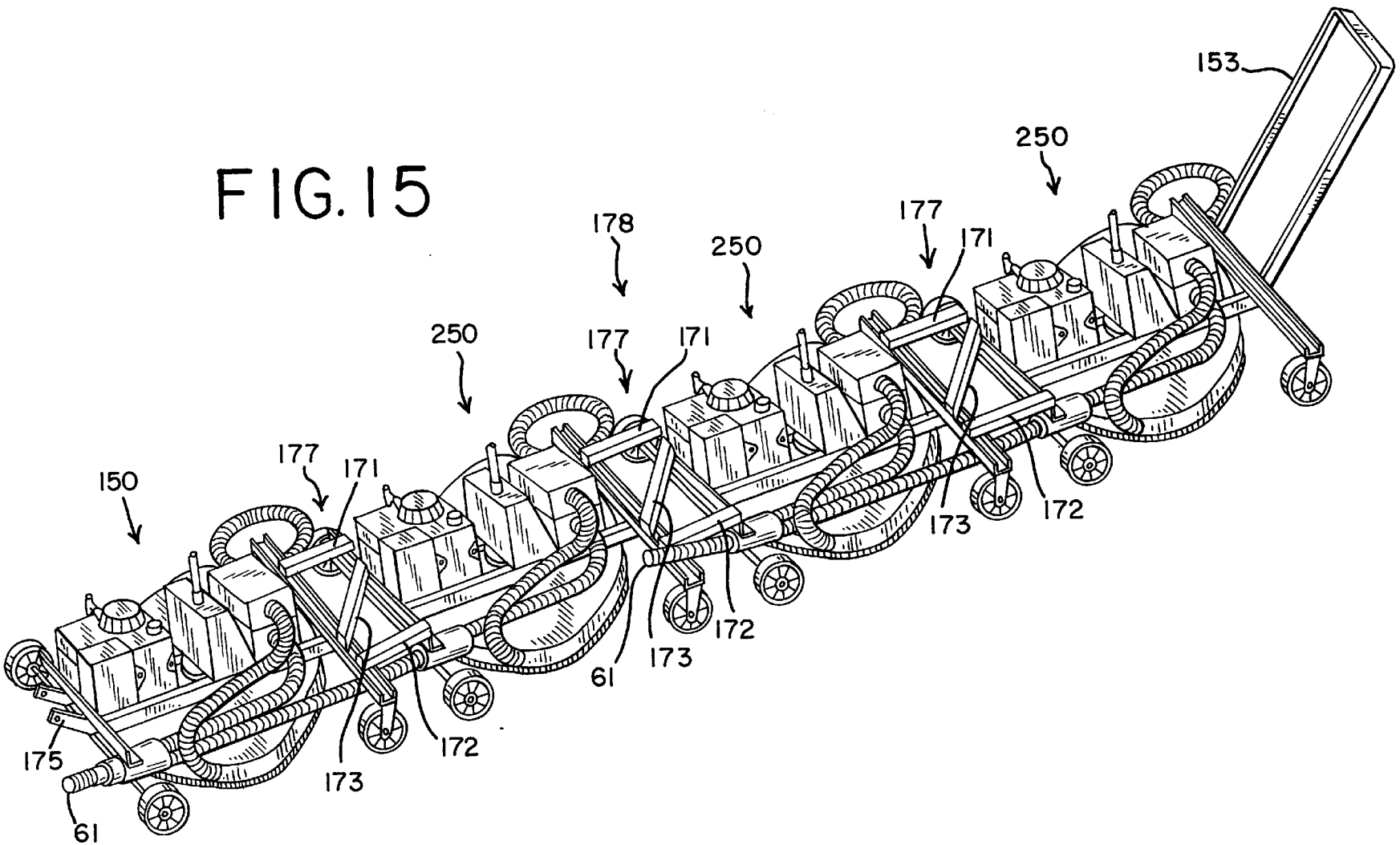
FIG. 15 is a top front perspective view of an embodiment of the invention in which a plurality of sprayers and retrieval units are hitched together and towed as a unit during operation.

Another embodiment, FIG. 15, is contemplated in which a plurality or series of roving sprayer and retrieval units 250, preferably of the type shown in FIGS. 12—14, are coupled together as a combined unit 178. The combined unit 178 can function as either a stand alone unit or in combination with a reclamation and recycling system 60. When functing as a stand alone unit is mounted to or on a self propelled vehicle which functions to move the combined unit 178 over the surface to be cleaned. When functing in combination with a reclamation and recycling system 60 the self propelled vehicle can also function to carry the reclamation components such as the filtration tank 400.

The combined unit 178 can be towed behind a self propelled vehicle that could also functions as the component carrying platform. In this embodiment one end of the series of roving sprayers 250 is hitched to the self propelled component carrying platform and a handle 153 is connected to the other end of the series. One operator drives the self propelled component carrying platform or vehicle 70 and a second operator controls the series of roving sprayers 250 through handle 153. In this embodiment the second operator can control the trailing end of the series of roving sprayer and retrieval units such that they extend at an angle to the direction of travel of the towing vehicle 70. In this embodiment the operator controlling the trailing end of the series can change the angle of the series of sprayers 250 relative to the direction of travel of the towing vehicle 70 such that the overlap of the sprayers 250 can be changed. When a portion of the surface being cleaned is encountered that is particularly dirty the overlap can be increased and the processing of this area of the surface will be multiplied. This of course reduces the swath but enables the surface to be cleaned uniformly with a single pass. Of course when an area of the surface is encountered that is particularly clean the overlap can be decreased and the swath increased. This embodiment has the advantages that fewer operators are required, adjustments can be made on the go for the condition of the particular area of surface being processed. The economy and the cleaning capacity of the system is greatly increased.

The combined unit 178 could also be supported by a hydraulically operated boom that extends forward from a self propelled vehicle, in clear view of the operator of the self propelled vehicle. This will allow a single operator to manage the entire system.

The combined unit 178 could also be carried by or mounted below a self propelled vehicle, in which case the combined unit would be maneuver along with the self propelled vehicle.

In the embodiment shown in FIG. 15, a plurality of retrieval units 250 are hitched together to form a combined unit 178. Although there are four roving sprayer and retrieval units 250 hitched together in FIG. 15, it should be understood that there could be fewer or more units hitched as a unit 178. The hitch mechanism 177 that connects two units 250 comprises first 171 and second 172 longitudinally extending links that are connected by ball joints at each end to the mobile frames 52 of adjacent unit 250. A transverse link 173 is also connected, at its opposite ends, by ball joints to the mobile frames 52 of adjacent units 250. This hitch mechanism 177 allows relative movement between adjacent roving sprayer and retrieval units 250 while maintaining the series of units aligned longitudinally. The hitch mechanism 177 will allow, for example, one roving sprayer and retrieval unit to be moving up an inclined surface while the adjacent unit is moving down a declining surface. The hitch mechanism 177 will also permit one roving sprayer and retrieval unit 250 to rotate relative to the adjacent unit that it is hitch to about the longitudinal axis of the combined unit.

The combined unit 178 shown in FIG. 15 could be hitched at its front end hitch members 175 to a self propelled vehicle such as a truck by a ball type hitch that will allow the combined unit to swivel relative to the towing vehicle. A handle 153 is secured to the mobil base 52 of the last roving sprayer and retrieval unit 250. An operator controls the combined unit 178 through the handle 153. In this embodiment a first operator who drives the towing vehicle and a second operator who controls the combined unit 178 can process considerably more surface area then when using a single roving sprayer and retrieval unit 250. The second operator can cause the combined unit 178 to extend along a line that in inclined to the direction of travel and thereby determine the swath that the combined unit will process in a pass of the device. The swath can be narrowed in areas where the debris is greater than in other areas. The first and second operators can communicate vocally through speakers and head sets and the driver of the towing vehicle can view the combined unit through a video system.

In the combined unit 178 shown in FIG. 15 the waste return hoses 61 of the first two units are combined and the waste return hoses 61 of the last two units are combined. As a result only two waste return hoses 61 extend to the towing vehicle 70.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited, to the particular use contemplated. It is intended that the scope of the invention be defined by the claims appended hereto.

What is claimed:

1. In a power wash system using high pressure water for cleaning flat surfaces including: a water storage means for holding water to be used for cleaning;

a water pumping system for pumping and pressurizing water from the water storage means;

a reclamation system for receiving water and matter that has been recovered from the surface being cleaned, separating the water from the matter and conveying the cleaned water back into said water storage means for reuse by the power wash system;

a water sprayer and retrieval unit for spraying the pressurized water onto and retrieving the water and matter from the surface being cleaned comprising:

a carriage unit;

a shroud comprised of a generally disk-shaped top having a skirt extending downwardly from the periphery thereof;

a hollow shaft journaled in the central portion of said disk-shaped top;

a power drive carried by said carriage, drive means for imparting rotation, in a given direction, to said hollow shaft from said power drive;

a retrieval rotor secured to said hollow shaft at a location below said disk shaped top, said retrieval rotor including a plurality of blades, said blades being secured to and radiating from said hollow shaft, said blades including substantially vertical curved surfaces that are curved away from said given direction of rotation and terminate adjacent said skirt;

at least one exit opening formed in said skirt;

at least one water jet secured to said retrieval rotor;

conduit means extending from said exit opening formed in said skirt to said reclamation system;

a water conduit extending from said water storage means for supplying pressurized water to the interior of said hollow shaft;

conduit means extending from the interior of said hollow pipe to said water jet through which water flows from the interior of said hollow pipe to said water jets and is sprayed on the surface to be cleaned.

2. The invention as set forth in claim 1 wherein said substantially vertical curved surfaces of the blades include a lip extending in said given direction along the lower edge thereof.

3. The invention as set forth in claim 2 wherein said downwardly extending skirt includes a substantially horizontal extending lip extending from the lower edge thereof toward the center of said shroud.

4. The invention as set forth in claim 3 wherein said downwardly extending skirt includes a substantially horizontal extending lip extending from the lower edge thereof toward the center of said shroud.

5. The invention as set forth in claim 2 wherein said substantially vertical curved surfaces of the blades include a lip extending in said given direction along the lower edge thereof.

6. The invention as set forth in claim 1 wherein said downwardly extending skirt includes a substantially horizontal extending lip extending from the lower edge thereof toward the center of said shroud.

7. The invention as set forth in claim 6 wherein said downwardly extending skirt includes a substantially horizontal extending lip extending from the lower edge thereof toward the center of said shroud.

8. The invention as set forth in claim 1 wherein said retrieval rotor includes stabilizers that extend between the tips of each adjacent blade.

9. A power wash system of the type recited in claim 1 wherein the invention further includes:

a positive displacement pump carried by said carriage;

drive means connecting said power drive to said positive displacement pump for driving said positive displacement pump;

said conduit means extending from said exit opening formed in said skirt to said reclamation system including:

a collection tank carried by said carriage;

said conduit emptying into said collector tank;

said pump connected to said collection tank and functioning to pump the contents of said collection tank through said conduit to said reclamation system.

10. In a power wash system using high pressure water for cleaning flat surfaces including:

a water sprayer and retrieval unit for spraying pressurized water onto and retrieving the water and matter from the surface being cleaned comprising:

a carriage unit;

a tank mounted on said carriage unit;

a shroud comprised of a generally disk-shaped top having a skirt extending downwardly from the periphery thereof;

a hollow shaft journaled in the central portion of said disk-shaped top;

a power drive carried by said carriage, drive means for imparting rotation, in a given direction, to said hollow shaft from said power drive;

a retrieval rotor secured to said hollow shaft at a location below said disk shaped top, said retrieval rotor including a plurality of blades, said blades being secured to and radiating from said hollow shaft, said blades including substantially vertical curved surfaces that are curved away from said given direction of rotation and terminate adjacent said skirt;

at least one exit opening formed in said skirt; at least one water jet secured to said retrieval rotor;

conduit means extending from said exit opening formed in said skirt to said tank for discharging water and recovered matter in said tank;

said tank includes a screen located below where said conduit means extending from said exit opening formed in said skirt to said tank discharges recovered water and matter into said tank such that large matter is collected by said screen and the filtered water passes through said screen;

a high pressure water inlet mounted on said water sprayer and retrieval unit for receiving high pressure water which is supplied to the interior of said hollow shaft;

conduit means extending from the interior of said hollow pipe to said water jet through which water flows from the interior of said hollow pipe to said water jets and is sprayed on the surface to be cleaned.

11. The invention as set forth in claim 10 wherein said substantially vertical curved surfaces of the blades include a lip extending in said given direction along the lower edge thereof.

12. The invention as set forth in claim 11 wherein said downwardly extending skirt includes a substantially horizontal extending lip extending from the lower edge thereof toward the center of said shroud.

13. The invention as set forth in claim 11 wherein said downwardly extending skirt includes a substantially horizontal extending lip extending from the lower edge thereof toward the center of said shroud.

14. The invention as set forth in claim 10 wherein said retrieval rotor includes stabilizers that extend between the tips of each adjacent blade.

15. A power wash system of the type recited in claim 10 wherein the invention further includes:

a reclamation system;

a pump carried by said carriage;

drive means for driving said pump;

said pump connected to said collection tank and functioning to pump the contents of said collection tank through said conduit to said reclamation system.

16. The invention as set forth in claim 15 wherein said substantially vertical curved surfaces of the blades include a lip extending in said given direction along the lower edge thereof.

17. The invention as set forth in claim 16 wherein said downwardly extending skirt includes a substantially horizontal extending lip extending from the lower edge thereof toward the center of said shroud.

18. The invention as set forth in claim 15 wherein said downwardly extending skirt includes a substantially horizontal extending lip extending from the lower edge thereof toward the center of said shroud.

19. The invention as set forth in claim 1 wherein a plurality of said water sprayer and retrieval units are coupled together in the fore and aft direction to form a combined unit;

a self propelled unit;

said water storage means, water pumping system and reclamation system carried by said self propelled unit;

hitching means for connecting said combined unit to said self propelled unit.

20. The invention as set forth in claim 19 wherein the means for coupling together said water sprayer and retrieval units in the fore and aft direction permits one water sprayer and retrieval unit to move up an inclined surface while an adjacent unit is moving down a declining surface and to permit one water sprayer and retrieval unit to rotate relative to the adjacent unit.

21. The invention as set forth in claim 19 wherein said substantially vertical curved surfaces of the blades include a lip extending in said given direction along the lower edge thereof.

22. The invention as set forth in claim 21 wherein said downwardly extending skirt includes a substantially horizontal extending lip extending from the lower edge thereof toward the center of said shroud.

23. The invention as set forth in claim 19 wherein said downwardly extending skirt includes a substantially horizontal extending lip extending from the lower edge thereof toward the center of said shroud.

24. The invention as set forth in claim 10 wherein a plurality of said water sprayer and retrieval units are coupled together in the fore and aft direction to form a combined unit;

a self propelled unit;

hitching means for connecting said combined unit to said self propelled unit.

25. The invention as set forth in claim 24 wherein the means for coupling together said water sprayer and retrieval units in the fore and aft direction permits one water sprayer and retrieval unit to move up an inclined surface while an adjacent unit is moving down a declining surface and to permit one water sprayer and retrieval unit to rotate relative to the adjacent unit.

26. The invention as set forth in claim 24 wherein said substantially vertical curved surfaces of the blades include a lip extending in said given direction along the lower edge thereof.

27. The invention as set forth in claim 26 wherein said downwardly extending skirt includes a substantially horizontal extending lip extending from the lower edge thereof toward the center of said shroud.

28. The invention as set forth in claim 24 wherein said downwardly extending skirt includes a substantially horizontal extending lip extending from the lower edge thereof toward the center of said shroud.

* * * * *

UNITED STATES PATENT AND TRADEMARK OFFICE

CERTIFICATE OF CORRECTION

PATENT NO. : 5,826,298

DATED : October 27, 1998

INVENTOR(S) : Richard D. Rohrbacher et al.

It is certified that error appears in the above-identified patent and that said Letters Patent is hereby corrected as shown below:

IN THE SPECIFICATION:

Column 1, line 41, change "disperse" to -- dispersed --;

line 48, change "is" to -- in --;

line 58, change "site" to -- site --.

Column 2, line 16, change "recover" to -- recovers --;

line 17, change "mater" to -- matter --;

line 53, change "mounting a" to -- mounted --.

Column 3, line 60, change "enlarge" to -- enlarged --.

Column 4, line 67, delete "can".

Column 5, line 9, after "retrieval" insert -- unit --;

line 54, change "provided" to -- provide --;

Column 7, line 8, change "carries" to -- carried --;

line 28, change "forces" to -- force --;

line 25, change "4-6 and 12" to -- 3-6 --;

line 34, change "moves" to -- move --;

line 36, change "cooperate" to -- cooperates --;

UNITED STATES PATENT AND TRADEMARK OFFICE

CERTIFICATE OF CORRECTION

PATENT NO. : 5,826,298

DATED : October 27, 1998

INVENTOR(S) : Richard D. Rohrbacher et al.

It is certified that error appears in the above-identified patent and that said Letters Patent is hereby corrected as shown below:

IN THE SPECIFICATION:

Column 7, line 38, change "ends" to -- end --;

line 41, change "flow" to -- flows--.

Column 8, line 18, change "chambers" to -- chamber --.

Column 11, line 25 change "operators" to -- operator --.

Column 12, line 3, change "11" to -- 12 --;

line 7, change "12 and 13" to -- 13 and 14 --;

line 8, change "12-12 and 13-13 of FIG. 11" to -- 13-13 and 14-14 of FIG. 12 --;

line 32, change "functing" to -- functioning --;

line 35, change "functing" to -- functioning --;

line 40, change "functions" to -- function --;

line 62, change "advantages" to -- advantage --;

line 62, change "adjustments" to -- and adjustments --.

UNITED STATES PATENT AND TRADEMARK OFFICE

CERTIFICATE OF CORRECTION

PATENT NO. : 5,826,298

DATED : October 27, 1998

INVENTOR(S) : Richard D. Rohrbacher et al.

It is certified that error appears in the above-identified patent and that said Letters Patent is hereby corrected as shown below:

IN THE SPECIFICATION:

Column 13, line 6, change "maneuver" to -- maneuvered --;

line 27, change "hitch" to -- hitched --;

line 33, change "mobil base" to -- mobile frame --;

line 38, change "then" to -- than --;

line 41, change "in" to -- is --.

Claim 13, Column 16, line 1, change "11" to -- 10 --.

Signed and Sealed this

Thirtieth Day of March, 1999

*Attest:*

Q. TODD DICKINSON

*Attesting Officer*

*Acting Commissioner of Patents and Trademarks*